United States Patent [19]

MacRae

[11] 4,196,934

[45] Apr. 8, 1980

[54] SHORTWALL MINING MACHINE

[75] Inventor: Ronald L. J. MacRae, Ashby-de-la-Zouch, England

[73] Assignee: Coal Industry (Patents) Limited, London, England

[21] Appl. No.: 879,883

[22] Filed: Feb. 21, 1978

[30] Foreign Application Priority Data

Feb. 25, 1977 [GB] United Kingdom ..... 08023/77

[51] Int. Cl.[2] ..... E21D 15/06

[52] U.S. Cl. ..... 299/32; 299/18; 299/33; 299/34; 299/43

[58] Field of Search ..... 299/18, 32, 34, 43, 299/33, 42

[56] References Cited

U.S. PATENT DOCUMENTS

| | | | |
|---|---|---|---|
| 1,710,801 | 4/1929 | Morgan | 299/33 |
| 3,640,580 | 2/1972 | White | 299/18 |
| 3,960,408 | 6/1976 | Johns | 299/19 |
| 4,065,184 | 12/1977 | Tipper | 299/34 |

FOREIGN PATENT DOCUMENTS

| | | | |
|---|---|---|---|
| 1443546 | 6/1976 | United Kingdom | 299/43 |

*Primary Examiner*—William F. Pate, III

*Attorney, Agent, or Firm*—Stevens, Davis, Miller & Mosher

[57] ABSTRACT

The invention provides a shortwall mining machine comprising an assembly, which preferably is articulated and has a protective canopy. The assembly is arranged parallel to a shortwall mineral face, and a cutter is hauled along a guide on the assembly to cut the face. As the face is cut the assembly is moved towards the face by use of rams connected between the assembly and stay units located in roadways adjacent the face. The cutter may be a scraper bucket or a plough, and is hauled across the face by either one motor in one of the roadways, or by two motors, one located in each roadway. The cutter may be steered by use of jacks on the assembly located in the roadways.

5 Claims, 10 Drawing Figures

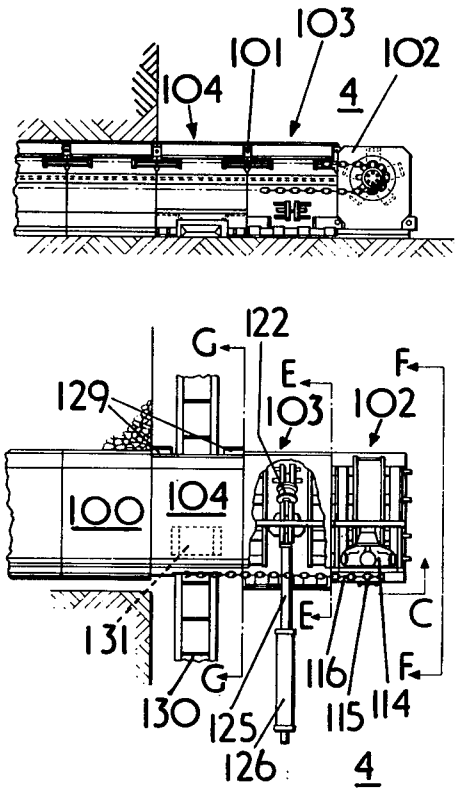
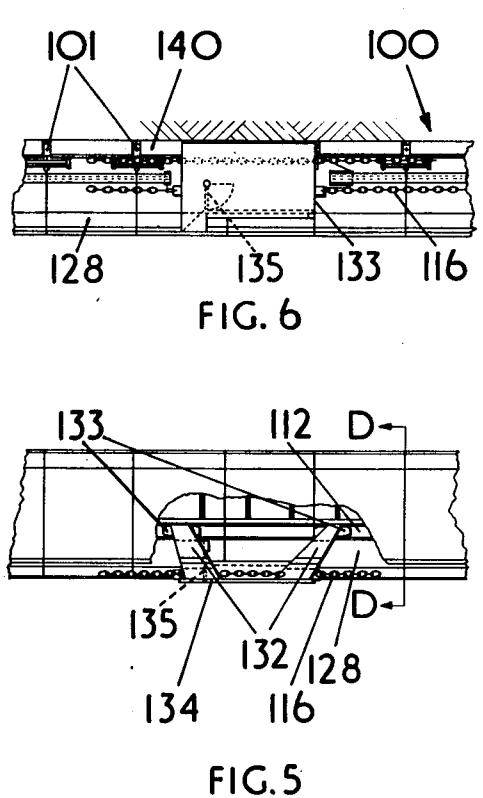
FIG. 6
FIG. 5
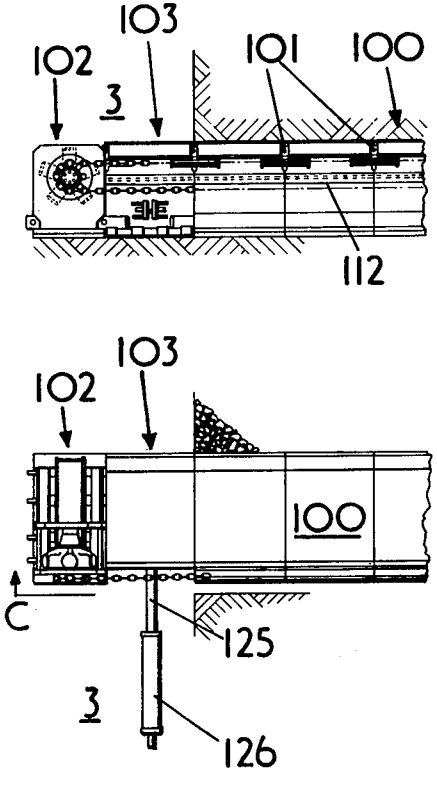

SHORTWALL MINING MACHINE

This invention relates to shortwall mining machines for mining underground mineral seams, and in particular, but not exclusively for use in retreat mining of coal seams.

An object of the present invention is to provide a shortwall mining machine which can be operated without the need for operators to be on the face during winning operations.

According to the present invention a shortwall mining machine, for use on a shortwall face having a roadway formed at each end thereof, comprises a substantially rigid elongate frame assembly arrangeable along the length of the face, mineral cutting means guided by the assembly and means arrangeable in the roadways to move the machine towards the mineral to be won.

Conveniently the assembly comprises a series of articulated sections, rigidly lockable together by, for instance, bolts or pins.

Preferably, steering means are provided for location in the roadway for adjusting the cutting horizon of the cutting means and thereby to steer the machine. The steering means may either move the machine up and down in a plane substantially parallel to the face or rotate the machine about a horizontal axis substantially parallel to the face. Conveniently, the steering means comprises at least one fluid-operable ram located at each end of the assembly in the roadway.

Preferably, the assembly includes a canopy to shield the machine when the mine roof collapses behind the advancing face.

Conveniently the mineral cutting means is hauled to and fro along the face on an endless rope or chain by means of a motor locatable in one of the roadways, the mineral cutting means having at least one working edge for winning mineral. In certain mineral cutting conditions a motor would be fitted in both roadways. Preferably, the or each working edge has at least one cutter tool.

The mineral cutting means may comprise at least one bucket adapted to win mineral while travelling in one direction along the face, and to discharge won mineral onto a conveyor in one of the roadways at the end of a traverse of the face in the opposite direction.

Alternatively, the mineral cutting means may comprise a plough adapted to win mineral while travelling in either direction along the face, but convey won mineral in one direction of travel only. For this purpose the plough may include a one-way door which is opened by won mineral while the plough travels in one direction but which is closed and acts as a dozer plate while the plough travels in the opposite direction.

The mineral cutting means may also comprise other commonly used mining winning machines, such as shearers and jib-cutters.

Advantageously the means whereby the machine is moved towards the face includes two stay units which are each anchorable in one of the roadways respectively. Each stay unit is preferably connected to the assembly by a fluid-operable ram and may be anchored in place in the roadway by use of a prop engageable with either the roadway roof supports or the roadway roof.

Ventilation means, preferably including an extractor fan arrangeable in one of the roadways and a shield tending to prevent recirculation of extracted air, may be provided to induce a flow of ventilating air along the face.

The mining machine according to the invention has the advantages that it can operate without any operators on the face, it can be steered, driven and moved by apparatus located in the roadways, and it can operate without the need for in-seam roof supports.

Advantageously, the machine according to the invention is used in the system known as retreat mining in which case the roadways are formed in advance of the face but may also be used in advance mining systems.

By way of example only, two embodiment of the present invention will be described with reference to the accompanying drawings, in which:

FIG. 5 is a plan view, partly cut-away, of a second embodiment of a mineral mining machine according to the invention;

FIG. 6 is an incomplete front view along line C—C of FIG. 5;

Figure 1:
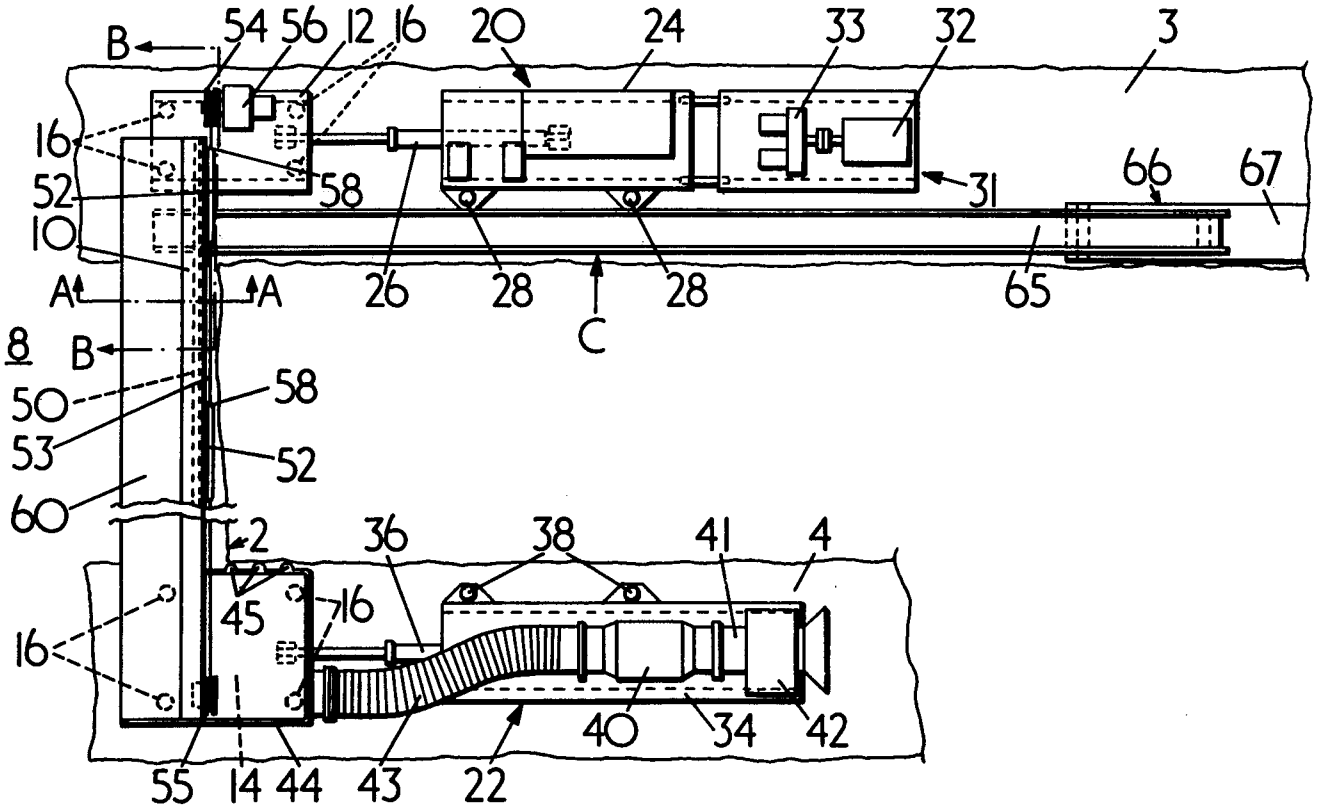
FIG. 1 is a plan of a first embodiment of a mining machine constructed in accordance with the present invention.
Figure 2:
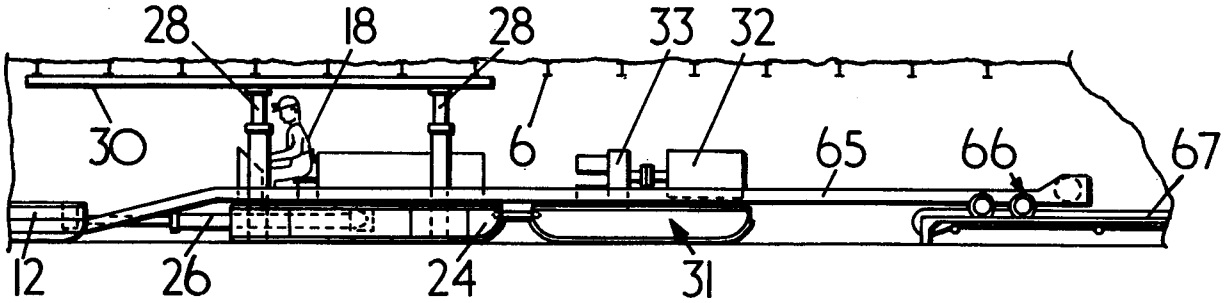
FIG. 2 is an incomplete side view looking in the direction of arrow C of FIG. 1.
Figure 4:
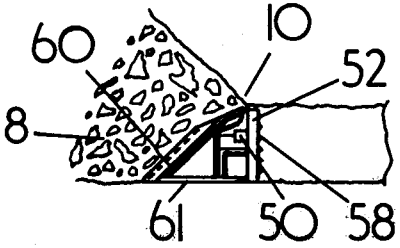
FIG. 4 is a sectional view taken along line A—A of FIG. 1.
Figure 3:
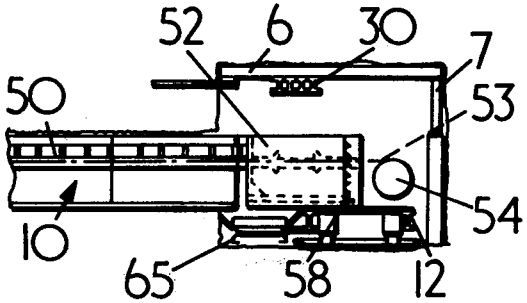
FIG. 3 is a sectional view taken along line B—B of FIG. 1.
Figure 8:
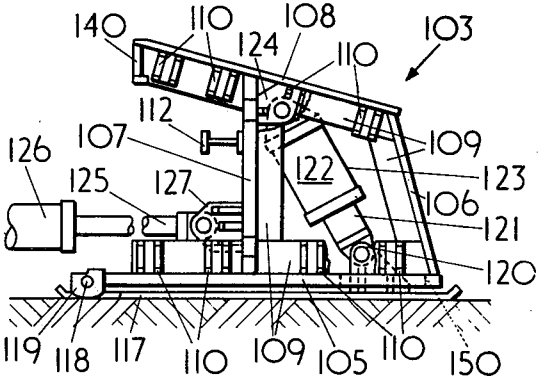
FIG. 8 is a side view, partly cut-away, along line E—E of FIG. 5.
Figure 10:
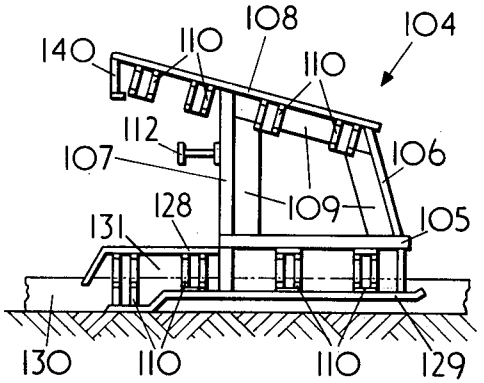
FIG. 10 is a side view along line G—G of FIG. 5.

Referring to FIGS. 1 to 4 of the drawings a first embodiment of a shortwall coal mining machine is shown installed along a shortwall face 2 having two roadways 3 and 4 formed at the ends of the face and in advance thereof. The roadways are supported by roof beams 6 and props 7 which are sequentially withdrawn as the face advances. Thus, the roadways are allowed to collapse with the goaf 8 behind the advancing face.

The mining machine comprises a rigid elongated frame assembly 10 extending along the length of the shortwall face, the ends of the frame assembly being carried on two stools 12 and 14 having vertically adjustable hydraulic legs 16 for adjusting the height of the frame assembly with respect to the mine floor.

The hydraulic legs 16 are controlled by an operator 18 (see FIG. 2) positioned on one of two stay units 20 and 22 anchorable in the roadways 3 and 4, respectively.

The stay unit 20 comprises a base 24 connected to the stool 12 by a hydraulic ram 26 and carrying a control cabin for the operator 18. Two hydraulically extendable legs 28 are provided on the base which acting through roof beams 30 serve normally to anchor the stay unit in position. A power unit 31 fixedly attached to the stay unit carries an electrically driven motor 32 for driving hydraulic equipment 33 for providing pressure fluid to actuate the various hydraulic motors and piston and cylinder devices on the machine.

The stay unit 22 comprises a base 34 connected to the stool 14 by a hydraulic ram 36 and carrying two hydraulically extendable legs 38 supporting roof beams (not shown) in similar manner to legs 28 and roof beams 30 of the stay unit 20 to releasably anchor the associated stay unit in position during cutting operation. The stay unit 22 carries an extractor fan 40 which is connected by ducting 41 to a dust filter device 42 for arresting dust particles from air flow extracted from the face and by flexible ducting 43 to a shield 44 tending to prevent recirculation of air. The efficiency of the shield 44 is increased by the use of seals 45 acting between the roadway side and the shield which boxes in the associated end of the frame assembly 10.

The frame assembly comprises a guide rail 50 along which a plurality of scraper buckets 52 are hauled to and fro by an effectively endless rope or chain 53 which is driven around pulleys 54 and 55 by a winch 56 (not shown in FIG. 3) controlled by the operator 18.

Each scraper bucket has a working edge for winning coal from the mineral face, the edge extending the height of the face and being provided with cutter tools 58.

A canopy 60 is secured to the rear of the frame assembly 10 to protect the machine from the mine roof which is substantially unsupported and collapses immediately behind the machine. The rigid elongated frame component 10 includes a floor member 61 fixedly securing the base of the canopy 60 to the frame assembly.

In operation the scraper buckets 52 are hauled to and fro such that the cutter tools 58 win coal from the mineral face, the rigid elongated frame assembly 10 is hauled forward continuously by the rams 26 and 36 secured to the anchored stay units 20 and 22. Cut mineral is urged towards the roadway 3 by the scraper buckets 52 acting in sequence until the bucket nearest to the roadway 3 discharges the cut mineral onto a discharge conveyor 65 positioned in the roadway 3. The discharge end of conveyor 65 is mounted on a wheel arrangement 66 which runs along a further roadway conveyor 67 arranged to receive mineral from the conveyor 65. The wheel arrangement ensures that as the machine advances the conveyor 65 can be continuously withdrawn without hindering operation of the machine.

The two advancing rams 26 and 36 are controlled such that advance of the two ends of the machine is maintained substantially constant and the two ends are kept in line. When the rams are fully retracted, the legs 28 and 38 are released from the anchoring position and the rams 26 and 28 are extended to push the released stay units 20 and 22 along the roadways away from the face. When the rams 26 and 36 are fully extended, the legs 28 and 38 are reset to anchor the stay units and the cutting operation is restarted. It will be appreciated that the advancing of the stay units is a simple operation which can be quickly completed. Thus, little coal producing time is lost during this operation.

As the machine advances it can be steered to ensure the cutter tools 58 cut a desired cutting horizon by adjustment of the legs 16 on the stools 12 and 14. Since the frame assembly is rigid the cutter tools are guided by the frame assembly on the desired cutting horizon. Also the rigid frame assembly ensures the face line is maintained straight throughout the length of the face.

During cutting ventilation air flow is induced along the face by the fan 40 and dust particles generated during cutting are arrested from the airflow by the filter device 42 before the air is discharged in the roadway 4.

Referring now to FIGS. 5 to 10, the second embodiment of a mining machine according to the invention is illustrated as being installed along a shortwall face 2 having two roadways 3 and 4 formed at the ends of the face 2 and in advance thereof. The roadways are supported as previously described with reference to the first embodiment. The mining machine comprises a series of identical sections 100, driving sections 102, steering sections 103 and a loading section 104, which in use are rigidly held together by pins 101 to form an assembly.

Each of the identical sections 100 comprises (see FIG. 7) a base plate 105 on which are fixed a back plate 106, which is slightly inclined towards the centre of the base plate 105, and a beam carrier plate 107, which is located approximately across the centre of the base plate 105 and perpendicular thereto. A covering plate 108, including a guard plate 140, is fixed onto the tops of the plates 106 to 107, and slopes upwardly from the back plate 106. Each of the plates 105 to 108 is strengthened by auxiliary plates 109. Forks 110 are provided on one of the edges of each of the base and covering plates 105 and 108, which forks may interlock with lugs (not shown) located on the opposite edges of an adjacent section 100. The forks 110 and lugs have holes formed in them, through which pins 101 may be passed to lock the sections 100 together rigidly. A block 111 is fixed onto the bottom of the base plate 105 on the edge which, in use is nearest the face 2, and the section 100 may pivot on this block 111. An I-beam 112 is fixed horizontally onto the beam-carrier plate 107 on the side thereof remote from the back plate 106, which beam 112 acts as a rail along which a pick carriage 113 may run. A track 128 is located on the base plate 105 on the same side of the beam-carrier plate 107 as the I-beam 112. The track 128 and guardplate 140 also assist in guiding the pick carriage 113 as it traverses the face 2.

Each drive section 102 (see FIG. 9) comprises a base plate 105, on which are fixed forks 110, lugs (not shown) and an hydraulic drive motor 114, to which is fixed a drive sprocket 115 for receiving a drive chain 116.

Each steering section 103 (see FIG. 8) comprises plates 105 to 109, forks 110, lugs (not shown), and I-beam 112 as for one of the sections 100. However the base plate 105 is pivotally attached to a pivot plate 117 by a pivot pin 118 through a bearing pad 119. An opening 150 is made in the base plate 105, through which opening 150 project a pair of triangular lugs 120 attached to the pivot plate 117. The head of the piston rod 121 of a single action hydraulic steering ram 122 is pivotally attached to the triangular lugs 120. The cylinder 123 of the steering ram 122 is pivotally attached to a pair of ribs 124 attached to both the beam-carrier plate 107 and the covering plate 108. The head of the piston rod 125 of a double action hydraulic haulage ram 126 is pivotally attached to a pair of further ribs 127 which are fixed to both the base plate 105 and the beam-carrier plate 107.

The loading section 104 (see FIG. 10) is the same as an identical section 100 except that the base plate 105 is curtailed and does not extend away from the back plate 106 beyond the beam-carrier plate 107. The loading section 104 is supported on two spaced apart feet 129 and has a chute 131 formed in the track 128 so that, in use, coal can be discharged through the chute 131 onto a conveyor 130 located between the feet 129.

The pick carriage 113 comprises a pick carriage plate 134 on which are mountable a plurality of picks (not shown), two locating arms 132, having on their ends beam engaging means 133, a one-way door 135 and chain engaging means 136.

In use a plurality of identical sections 100 is disposed along the length of the shortwall face 2 so that the sections 100 extend along the whole face. The identical sections 100 are disposed with the I-beam 112 adjacent the face 2. A conveyor 130 is located in one roadway (in this case the right hand roadway 4 as viewed in FIGS. 5 and 6) and the loading section 104 is placed over the conveyor 130. A steering section 103 and a drive section 102 are then disposed at each end of the assembly. All the sections 100 and 102 to 104 are locked rigidly together by inserting pins 101 into the holes provided in the lugs and forks 110. This is preferably carried out sequentially in the roadway (3 or 4) as the sections 100 are disposed along the face 2.

Figure 7:
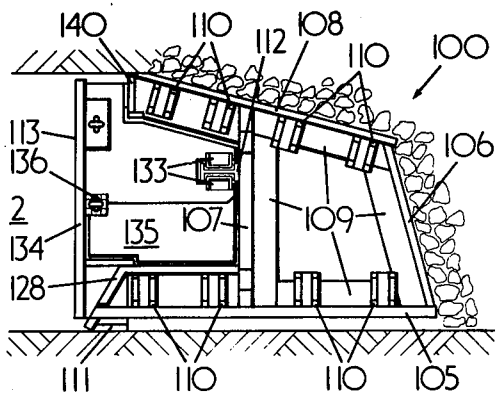
FIG. 7 is a side view along line D—D of FIG. 5.
Figure 9:
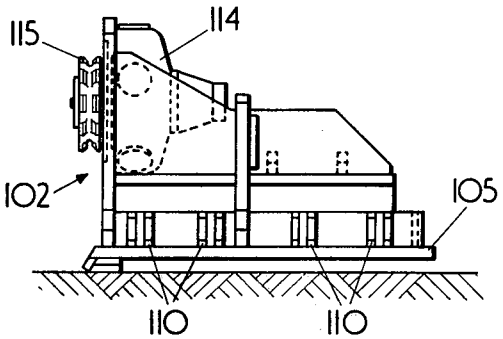
FIG. 9 is a side view along line F—F of FIG. 5.

The pick carriage 113, having picks fixed thereon in such a fashion that coal may be cut in both directions of travel of the carriage 113, is located on the rail 112 as shown in FIGS. 5, 6 and 7, with the rail-engaging means 133 and chain engaging means 136 attached to the I-beam 112 and chain 116 respectively. The chain 116 is located over the sprocket 115 on the drive sections 102.

The haulage rams 126 are pivotally attached to stay units (not shown) located in the roadways. The stay units function in a similar fashion to the stay units 20 and 22 hereinbefore described with reference to the first embodiment. An operator (not shown) on the stay units controls the drive motors 114, the steering rams 122 and the haulage rams 126.

To win coal the pick carriage 113 is traversed to and fro across the face 2. As it travels it wins coal which falls onto the tracks 128. As the carriage 113 travels from right to left as shown in FIGS. 5 and 6 the door 135 can open, and so the carriage 113 passes over the won coal. As the carriage travels in the opposite direction the door 135 is closed and the carriage 113 ploughs the coal towards the chute 131 through which it is discharged onto the conveyor 130.

As coal is won from the face 2 the haulage rams 126 are retracted in phase causing the machine to move towards the face 2 and enabling more coal to be won. If the seam in which the machine is located undulates the cutting horizon of the machine is alterable by activating the steering rams 122 which pivot the machine about the axis of pivot pin 118. As the machine advances, the seam roof (and the roadway if desired) is allowed to collapse. The machine is protected from damage by the back and cover plates 106 and 108 respectively.

When the haulage rams 126 are fully retracted the stay units are moved along the roadway as described with reference to the first embodiment. The stay units include ventilation means (not shown) also as previously described.

From the above description it can be seen that the present invention provides a shortwall mining machine which does not require an operator on the face during cutting operations.

I claim:

1. A shortwall mining machine, for use on a shortwall face having a roadway at each end thereof, comprising:

(a) a substantially rigid elongate frame assembly adapted to be arranged along the length of the face, the assembly comprising a series of articulated sections adapted to be rigidly locked together;

(b) mineral cutting means guided by the assembly;

(c) moving means adapted to be arranged in the roadways to move the machine towards the mineral to be won; and (d) steering means adapted to be located in at least one of the roadways and to be connected to at least one of the sections for adjusting the cutting horizon of the cutting means and thereby to steer the machine.

2. A machine according to claim 1, wherein the assembly includes a canopy to shield the machine.

3. A machine according to claim 1, wherein the cutting means comprises at least one bucket, located on an endless chain driven by a motor locatable in one of the roadways, the bucket having a working edge for winning mineral and being adapted to win mineral while travelling in one direction along the face, and to discharge won mineral onto a conveyor in one of the roadways at the end of a traverse of the face in the opposite direction.

4. A machine according to claim 1, wherein the cutting means comprises a plough, locatable on an endless chain driven by a motor locatable in one of the roadways, the plough having two working edges for winning mineral being adapted to win mineral while travelling in either direction along the face, and including a one-way door which is adapted to be opened by won mineral while the plough travels in one direction but which is closed to convey won mineral to a conveyor in one of the roadways while the plough travels in the opposite direction.

5. A machine according to claim 1, wherein the moving means includes two stay units which are each anchorable in one of the roadways respectively by use of a prop engageable with either the roadway roof support, each stay unit being connectible to the assembly by a fluid operable ram.

* * * * *